US008869423B2

(12) United States Patent
Nicholson

(10) Patent No.: US 8,869,423 B2
(45) Date of Patent: Oct. 28, 2014

(54) METHODS AND APPARATUS TO FACILITATE DRYING GOLF GLOVES

(75) Inventor: Dennis Lawrence Nicholson, Eureka, MO (US)

(73) Assignee: DJ Nicholson Enterprises LLC, Eureka, MO (US)

( * ) Notice: Subject to any disclaimer, the term of this patent is extended or adjusted under 35 U.S.C. 154(b) by 0 days.

(21) Appl. No.: 10/728,233

(22) Filed: Dec. 4, 2003

(65) Prior Publication Data

US 2005/0120579 A1 Jun. 9, 2005

(51) Int. Cl.
*D06F 59/04* (2006.01)
*F26B 5/00* (2006.01)
*A63B 71/14* (2006.01)

(52) U.S. Cl.
CPC ..... *D06F 59/04* (2013.01); *A63B 71/146* (2013.01)
USPC ..... 34/437; 34/511; 34/104; 34/239

(58) Field of Classification Search
CPC ..... D06F 59/04
USPC ..... 34/103, 104, 106, 239, 437, 511; 40/662–669
See application file for complete search history.

(56) References Cited

U.S. PATENT DOCUMENTS 3,368,811 A * 2/1968 Finney ..... 473/300
3,508,280 A * 4/1970 Osborn ..... 2/159
3,587,570 A * 6/1971 Kilbey ..... 602/36
3,917,266 A * 11/1975 Kiey ..... 473/131
4,755,177 A * 7/1988 Hill ..... 604/336
4,939,818 A * 7/1990 Hahn ..... 24/16 R
5,177,881 A * 1/1993 Moore ..... 34/239
5,267,945 A * 12/1993 Doctor et al. ..... 602/14
5,309,328 A * 5/1994 Lum ..... 361/809
5,528,773 A * 6/1996 Lowinger ..... 2/161.4
5,898,944 A * 5/1999 Vrany ..... 2/161.4
5,913,461 A * 6/1999 Boudreau et al. ..... 223/78
5,934,530 A * 8/1999 Antczak et al. ..... 224/197
5,983,518 A * 11/1999 Ellenburg ..... 34/106
6,421,836 B1 * 7/2002 Park ..... 2/161.4
6,443,187 B1 * 9/2002 Wang et al. ..... 139/391
6,471,091 B1 * 10/2002 Unverzagt ..... 221/185
6,499,227 B1 * 12/2002 Jacobson ..... 34/106
6,520,925 B1 * 2/2003 Thibodo, Jr. ..... 602/22
6,622,346 B2 * 9/2003 Graham et al. ..... 24/16 R
2002/0138953 A1 * 10/2002 Passafiume ..... 24/306
2004/0084495 A1 * 5/2004 Rudeen et al. ..... 224/668

* cited by examiner

*Primary Examiner* — Jiping Lu
(74) *Attorney, Agent, or Firm* — Armstrong Teasdale LLP

(57) ABSTRACT

A golf cart includes at least one external surface and an apparatus for coupling a glove to the at least one external surface. The apparatus comprises a body comprising an inner surface and an outer surface. The body is coupled to the golf cart such that the inner surface remains in substantial contact against the at least one external surface during operation of the golf cart. The body outer surface includes at least one fastening mechanism for removably coupling a glove to the body such that the glove remains coupled to the apparatus during operation of the golf cart.

1 Claim, 3 Drawing Sheets

METHODS AND APPARATUS TO FACILITATE DRYING GOLF GLOVES

BACKGROUND OF THE INVENTION

This invention relates generally to gloves used in sporting activities, and more particularly to methods and apparatus for drying a golf glove.

Golfers use golfing gloves during play to improve their grip upon golf clubs and to keep their hands warm in inclement weather. While playing golf, golfers may frequently remove their golf glove as the glove becomes damp from perspiration, or during different aspects of the game, such as during putting. Typically, the glove is stuffed into the golfer's pants pocket until needed again, or alternatively, if a golf cart is being used, the glove may be placed within the golf cart. However, inserting a glove within a golfers' pocket, may actually cause the glove to become crumpled and/or disfigured. In addition, neither of these typical storage locations facilitates drying the glove during the round of golf.

Several products have been designed to facilitate drying gloves during a round of golf. Specifically, at least one known drying system uses a strap which hangs loosely from a golf club bag. The glove is coupled to the strap with a fastener extending from the strap. However, because the strap hangs from the golf bag stored behind the driver on the cart, the drying effectiveness may be limited because the golf glove is not directly exposed to air flowing past the moving golf cart.

Accordingly, to facilitate increasing the airflow to the golf glove, other known drying systems use an attachment member which extends outward a distance from a frame used to support the roof of the golf cart. However, because the attachment member extends outward, the attachment member may be cumbersome to passengers exiting and entering the golf cart, and/or may become undesirably snagged on obstacles, such as trees or bushes, as the golf cart navigates the golf course.

BRIEF DESCRIPTION OF THE INVENTION

In one aspect, a golf cart is provided. The golf cart includes at least one external surface and an apparatus for coupling a glove to the at least one external surface. The apparatus comprises a body comprising an inner surface and an outer surface. The body is coupled to the golf cart such that the inner surface remains in substantial contact against the at least one external surface during operation of the golf cart. The body outer surface includes at least one fastening mechanism for removably coupling a glove to the body such that the glove remains coupled to the apparatus during operation of the golf cart.

In another aspect, a golf cart including a passenger compartment, at least one frame support, a dashboard, a roof, and a glove drying system is provided. The at least one frame support and the dashboard are adjacent to the passenger compartment. The roof extends over at least a portion of the passenger compartment. The glove drying system is coupled to an external surface of at least one of the passenger compartment, the at least one frame support, the dashboard, and the roof. The golf drying system includes a first end, a second end, and a body extending therebetween. The body includes an inner surface and an outer surface, and is coupled to the golf cart such that substantially all of the inner surface remains against the golf cart external surface during operation of the golf cart. The body outer surface includes at least one fastening mechanism for removably coupling a glove to the system such that the glove remains coupled to the system during operation of the golf cart.

In a further aspect, a method of drying golf glove is provided. The method comprises providing a golf drying system that includes a body having an inner surface and an opposite outer surface, coupling the golf drying system to the golf cart such that substantially all of the body inner surface remains in contact with an external surface within the golf cart during operation of the golf cart, and removably coupling a golf glove to the golf cart using at least one fastening mechanism extending from the body outer surface, such that the golf glove remains suspended from the golf drying system during operation of the golf cart.

DETAILED DESCRIPTION OF THE INVENTION

Figure 1:
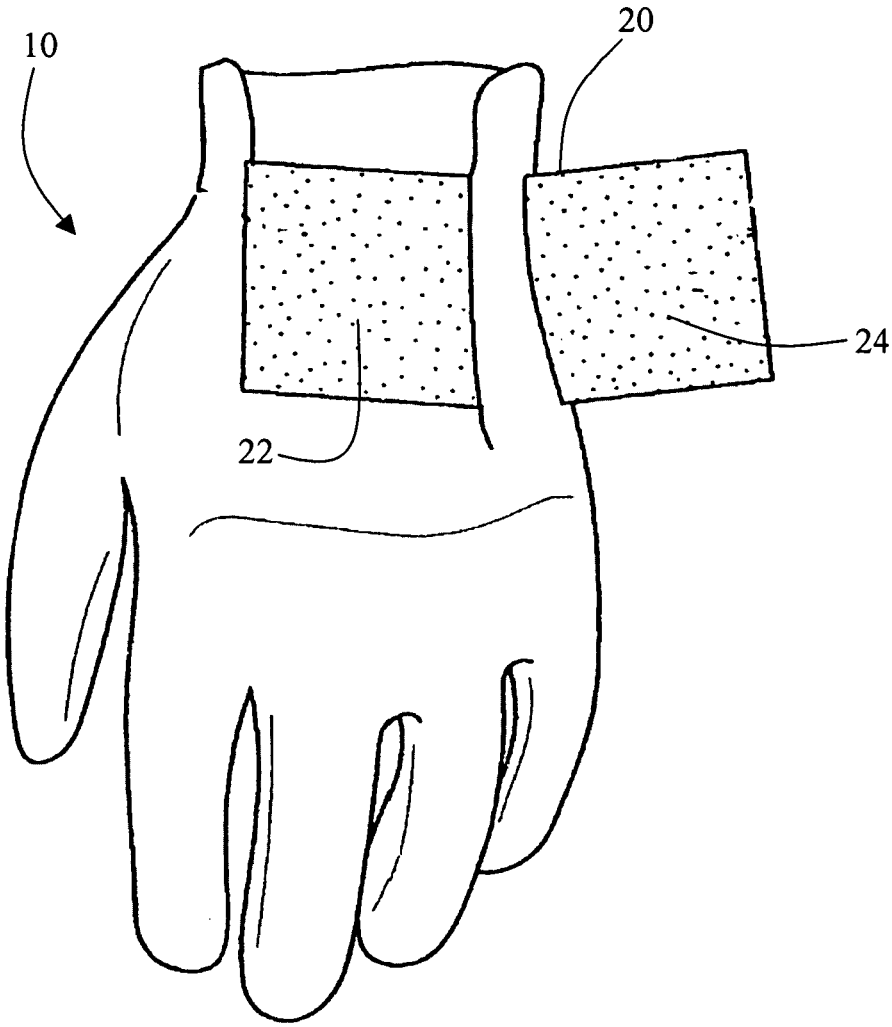
FIG. 1 is a side view of an exemplary golf glove.
Figure 2:
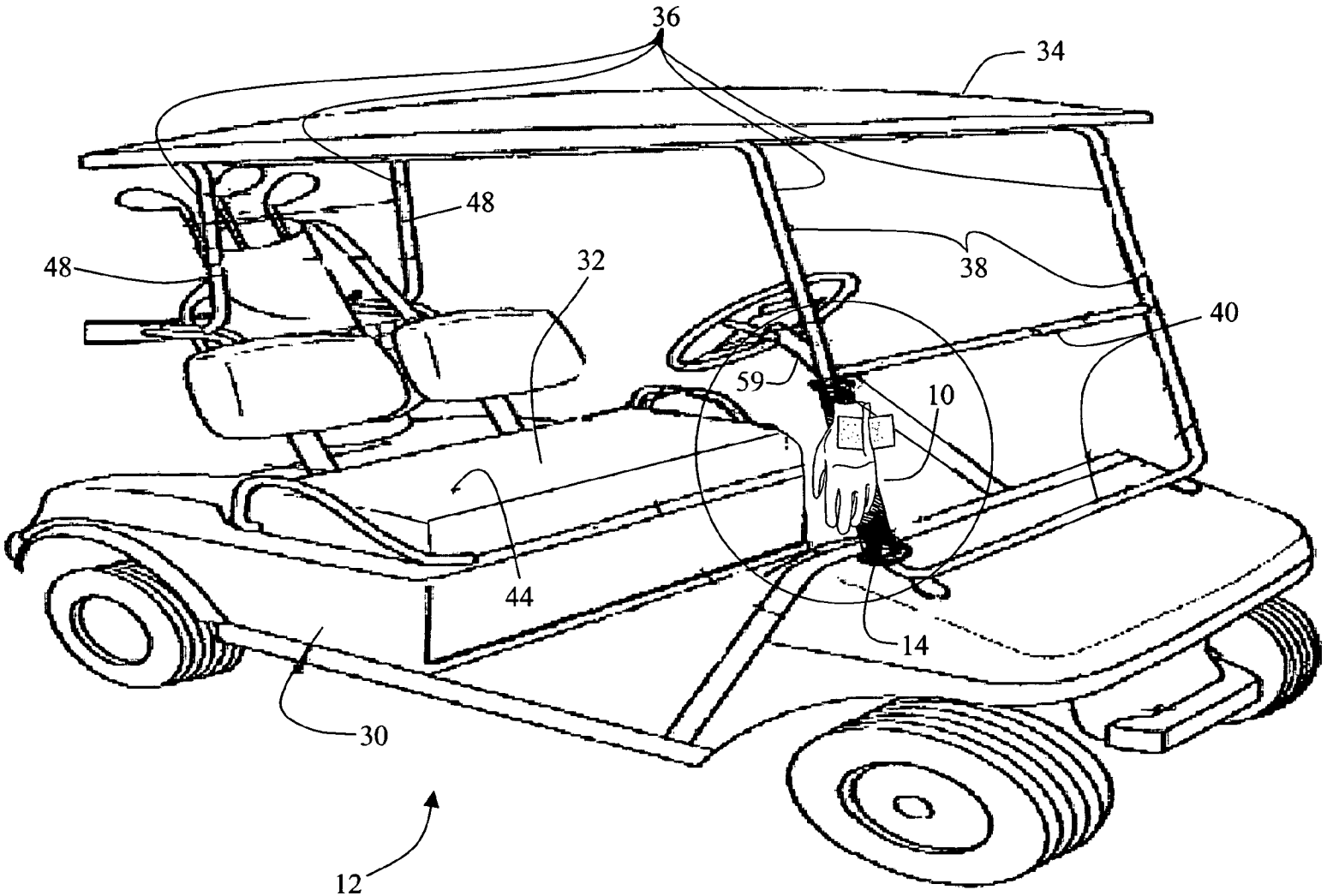
FIG. 2 is a perspective view of an exemplary golf cart including a golf glove drying system.
Figure 3:
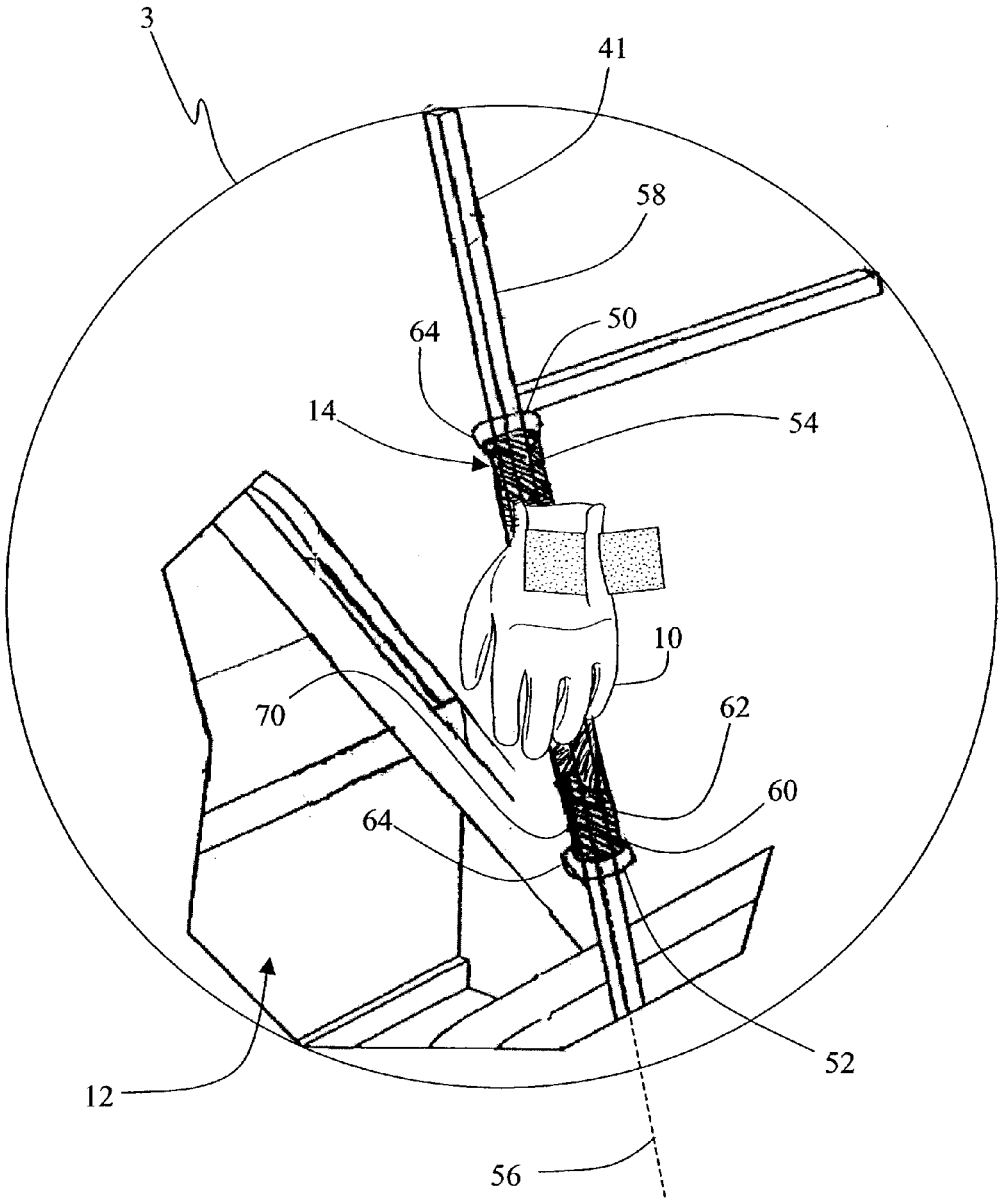
FIG. 3 is an enlarged view of the golf glove drying system shown in FIG. 2 and taken along area 3 shown in FIG. 2.

FIG. 1 is a side view of an exemplary golf glove 10. FIG. 2 is a perspective view of an exemplary golf cart 12 including a golf glove drying system 14. FIG. 3 is an enlarged view of golf glove drying system 14 taken along area 3 (shown in FIG. 2). Glove 10 is designed to fit snugly to a person's hand and includes a closure strap 20 used to firmly secure glove 10 to the golfer's hand. In the exemplary embodiment, strap 20 includes hook and pile fasteners extending from a backing portion 22 and a flap portion 24. In an alternative embodiment, strap flap portion 24 extends from backing portion 22 and through a slot formed in glove 10.

Accordingly, during use, flap portion 24 is pulled across glove 10 towards backing portion 22, and pressed against backing portion 22, such that glove 10 is secured to the golfer's hand. By adjusting the amount of distance that flap portion 24 is pulled across glove 10, the user can adjust the relative tightness of glove 10 to their hand. Alternatively, any other suitable fastening device or retaining device may be used which facilitates securing glove 10 to the wearer's hand, such as, but not limited to mechanical fastening devices, such as buckles, interlocking devices, hook and loop fasteners, tab and slot devices, locking mechanisms, magnets, tying systems, clips, and/or any combination thereof Golf cart 12 includes a body 30 that includes a passenger seating area 32 that is substantially covered by a roof 34. Roof 34 is coupled to body 30 by a plurality of frame supports 36 which extend upwardly from body 30. More specifically, golf cart 12 includes a pair of opposed, generally vertically-extending forward frame supports 38 which are coupled together by a plurality of generally horizontally-extending frame supports 40, which when coupled together, not only support roof 34, but also provide an attachment frame to enable a windshield (not shown) to couple to golf cart 12. In the exemplary embodiment, frame supports 38 are hollow, metallic, tubing members that have a substantially rectangular cross-sectional profile that is defined by four sides 41.

In the exemplary embodiment, golf glove drying system 14 is removably coupled to a forward frame support 38 adjacent a passenger's side 44 of passenger seating area 32. Alternatively, golf glove drying system 14 is permanently coupled within golf cart 12. Moreover, in an alternative embodiment, golf cart 12 includes a plurality of drying systems 14 coupled thereto. In a further alternative embodiment, drying system 14 is coupled to at least one horizontally-extending frame support 40 and/or to at least one generally vertically-extending rear frame support 48.

In the exemplary embodiment, system 14 includes a first end 50, a second end 52, and a body 54 that extends lengthwise between ends 50 and 52. Body 54 has a centerline axis of symmetry 56 extending therethrough between ends 50 and 52. To facilitate minimizing movement of system 14 with respect golf cart 12, system 14 is coupled to golf cart 12 such that body 54 is coupled against a substantially solid and hard surface 58. In the exemplary embodiment, to facilitate increasing the structural rigidity of system 14, system 14 is coupled to golf cart 12 such that body 54 is substantially concentrically aligned in a lengthwise direction with respect to each respective frame 38, 32, or 40. In an alternative embodiment, system 14 may be coupled to any surface 58 within golf cart 12, including but not limited to, the windshield, a dashboard (not shown), and/or a steering column 59.

Body 54 has an inner surface 60 and an outer surface 62. Inner surface 60 is coupled against a respective golf cart frame 38, 32, or 40. In the exemplary embodiment, each end 50 and 52 of system 14 includes a fastening mechanism 64 that enables system 14 to be secured to golf cart 12 such that body inner surface 60 remains substantially in contact with surface 58 during operation of golf cart 12. More specifically, in the exemplary embodiment, fastening mechanisms 64 are straps that are covered with a hook and pile material such that straps 64 may loop around each respective frame member 32, 38, and/or 40 and couple to themselves to secure system 14 to golf cart 12. Alternatively, any other suitable fastening mechanism 64 or retaining device may be used which facilitates securing system 14 to golf cart 12, such as, but not limited to mechanical fastening devices, interlocking devices, hook and loop fasteners, tab and slot devices, locking mechanisms, magnets, tying systems, clips, and/or any combination thereof. For example, in another alternative embodiment, system ends 50 and 52 do not include fastening mechanisms 64, but rather body 54 is coupled directly against a respective frame member 32, 38, and/or 40 using any suitable fastening mechanism that facilitates coupling body 54 against frame 32, 38, and/or 40, such as, but not limited, to an adhesives, tapes, mechanical fastening devices, interlocking devices, hook and loop fasteners, hook and pile fasteners, tab and slot devices, locking mechanisms, magnets, tying systems, and/or clips. In an alternative embodiment, system ends 50 and 52 do not include fastening mechanisms 64, and system 14 is not removably coupled within golf cart 12, but rather body 54 is permanently coupled within golf cart 12.

In the exemplary embodiment, body 54 is sized to extend substantially circumferentially around a respective frame 32, 38, and/or 40. Alternatively, body 54 substantially covers only one frame side 41. In a further alternative embodiment, body 54 extends across at least two frame sides 41.

In the exemplary embodiment, body outer surface 62 is formed integrally with a fastening mechanism 70 that enables glove 10 to couple thereto in a mating arrangement with closing strap 20. Body outer surface fastening mechanism 70 is variably selected to enable closing strap 20 to couple directly thereto. For example, in the exemplary embodiment, closing strap 20 is covered with a hook and pile material, and body outer surface 62 is covered with a hook and pile material that enables either glove strap flap portion 24 and/or strap backing portion 22 to couple directly against outer surface 62. Body outer surface fastening mechanism 70 is variably selected to enable closing strap 20 to couple directly thereto. In an alternative embodiment, fastening mechanism 70 may include, but is not limited to, adhesive materials, double-sided tapes, mechanical fastening devices, interlocking devices, hook and loop fasteners, tab and slot devices, locking mechanisms, magnets, tying systems, and/or clips, depending on which fastening device is used with strap 20. In an alternative embodiment, system 14 also includes a fastening mechanism coupled thereto, such as a ring, that enables other golf paraphernalia and equipment, such as a golf hat or a towel, to be secured thereto when system 14 is coupled within golf cart 12.

During use, when a glove 10 becomes damp, or when a golfer desires to remove glove 10 during non-use, system 14 provides a convenient location for a golfer to temporarily store glove 10. Furthermore, because glove 10 is coupled securely to golf cart 12 with system 14 such that glove 10 is within easy reach and view of passenger seating area 32, the risk of a glove 10 being lost while stored is reduced with system 14 in comparison to other potential temporary storage locations for glove 14 during a round of golf. In addition, a coupling location of system 14 relative to golf cart 12 enables glove(s) secured thereto to be continuously exposed to air flowing past golf cart 12, especially during movement of golf cart 12. As such, even on a hot and humid day, with little or no wind, when cart 12 is in motion, system 14 facilitates drying gloves 10. Moreover, system 14 facilitates drying gloves 10 without stretching glove 10, or without the use of a cumbersome attachment mechanism, or without requiring a wet glove to be uncomfortably inserted in a golfer's pocket.

The above-described golf glove drying systems are cost-effective and highly reliable. Each system enables a glove to be easily coupled in a location that is easily accessible and remains in view of seated passengers within the golf cart. Moreover, the drying system enables the glove to be secured to the golf cart in a location that facilitates drying the glove without the use of a cumbersome attachment mechanism, or without folding or distorting the shape of the glove. Furthermore, the drying system is easily installable, and as such, in the exemplary embodiment, may be removed and un-removed quickly and substantially effortlessly. Accordingly, the golf glove drying system facilitates drying and storing golf gloves in a cost-effective and reliable manner.

Exemplary embodiments of golf gloves, golf carts, and drying systems are described above in detail. The gloves, carts, and drying mechanisms are not limited to the specific embodiments described herein, but rather, components of each may be utilized independently and separately from other components described herein.

While the invention has been described in terms of various specific embodiments, those skilled in the art will recognize that the invention can be practiced with modification within the spirit and scope of the claims.

What is claimed is:

1. A method of drying a damp golf glove including a flap portion and a backing portion covered in hook and pile material, said method comprising:

providing a golf cart frame support that includes a longitudinal axis extending therethrough;

providing an apparatus comprising:

a first end including a first strap, the first strap covered in hook and pile material;

an opposing second end including a second strap, the second strap covered in hook and pile material; and a body extending from the first end to the second end, the body including an inner surface and an opposing outer surface, the body includes a major central axis extending from said first end to said second end;

coupling the apparatus to the support such that the body and the first and second straps substantially circumscribe the support, wherein the body substantially conforms to and is coupled against at least one external surface of the support when the apparatus is coupled to the support, the body wrapped substantially concentrically about the support such that the major central axis is aligned with the longitudinal axis of the support and such that said body remains substantially in contact with the at least one external surface of the support;

securing the apparatus to the support using the first strap and the second strap, wherein each of the first and second straps loop around the support and couple to themselves;

removably coupling the golf glove flap portion and the golf glove backing portion to hook and pile material covering the body outer surface such that the glove is directly coupled against the body outer surface in a mating arrangement when the apparatus is coupled to the support; and drying the golf glove when the golf glove is coupled to the apparatus by exposing the golf glove to air flowing past the support when the support is in motion.

* * * * *